US012338093B2

(12) United States Patent
Van Dongen et al.

(10) Patent No.: US 12,338,093 B2
(45) Date of Patent: Jun. 24, 2025

(54) SHEET STACKER FOR THIN OR WEAK PRINT MEDIA

(71) Applicant: Canon Production Printing Holding B.V., Venlo (NL)

(72) Inventors: Peter J. W. Van Dongen, Venlo (NL); Hermanus M. Kuypers, Venlo (NL); Frank J. W. Zeelen, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 145 days.

(21) Appl. No.: 18/097,681

(22) Filed: Jan. 17, 2023

(65) Prior Publication Data

US 2023/0242366 A1 Aug. 3, 2023

(30) Foreign Application Priority Data

Feb. 1, 2022 (EP) ..... 22154460

(51) Int. Cl.
*B65H 29/40* (2006.01)
*B65H 29/22* (2006.01)
*B65H 29/24* (2006.01)

(52) U.S. Cl.
CPC ..... *B65H 29/247* (2013.01); *B65H 29/22* (2013.01); *B65H 29/40* (2013.01); *B65H 2301/33224* (2013.01); *B65H 2301/4212* (2013.01); *B65H 2301/4461* (2013.01); *B65H 2404/65* (2013.01); *B65H 2801/06* (2013.01)

(58) Field of Classification Search
CPC ..... B65H 29/22; B65H 29/40; B65H 29/245; B65H 29/246; B65H 29/247; B65H 2404/65; B65H 2301/4212; B65H 2301/446; B65H 2301/33224; B65H 2301/4461; B65H 2406/12; B65H 2406/1211; B65H 2406/122; B65H 2406/1222
See application file for complete search history.

(56) References Cited

U.S. PATENT DOCUMENTS 4,220,323 A * 9/1980 Smith ..... B65H 29/58 271/65
4,431,178 A * 2/1984 Kokubo ..... B65H 29/40 271/187
4,575,069 A * 3/1986 Burkhart ..... B65H 31/02 271/186

(Continued)

OTHER PUBLICATIONS

European Search Report, issued in Priority Application No. 22154460.4, dated Jul. 21, 2022.

*Primary Examiner* — Luis A Gonzalez
(74) *Attorney, Agent, or Firm* — Birch, Stewart, Kolasch & Birch, LLP

(57) ABSTRACT

When using a flipping wheel to flip sheets of weak or long media, there is a risk that these sheets collapse upon themselves. To reduce this risk, a method of stacking sheets includes flipping a sheet while holding its leading edge and bringing the leading edge down towards a stack support; bringing a trailing portion of the sheet into contact with a guide member positioned over the stack support; forming an overpressure in an inner volume of the bent sheet during flipping, while its trailing portion is in contact with the guide member; and maintaining the overpressure and contact while a trailing edge of the sheet travels along the guide member.

16 Claims, 3 Drawing Sheets

(56) References Cited

U.S. PATENT DOCUMENTS

| | | | | |
|---|---|---|---|---|
| 4,736,941 | A * | 4/1988 | Petersen | B65H 29/68 271/70 |
| 5,261,655 | A | 11/1993 | Keller et al. | |
| 9,457,980 | B2 | 10/2016 | Kuypers et al. | |
| 10,000,353 | B2 | 6/2018 | Prinsen | |
| 2005/0280198 | A1* | 12/2005 | Laluk | B65H 29/40 271/94 |
| 2010/0109228 | A1 | 5/2010 | Obara | |
| 2011/0309566 | A1* | 12/2011 | Taniguchi | B65H 29/40 271/4.1 |
| 2012/0235348 | A1 | 9/2012 | Albers et al. | |
| 2021/0163243 | A1* | 6/2021 | Ruiz | B65H 29/22 |

* cited by examiner

SHEET STACKER FOR THIN OR WEAK PRINT MEDIA

BACKGROUND OF THE INVENTION

1. Field of the Invention

The invention relates to a sheet stacker, a printing system comprising a sheet stacker, an a method for stacking sheets of printed media.

2. Description of Background Art

Sheet stackers form stacks of sheets, for example from printed sheets supplied from a printing system. Such sheet stackers may comprise a flipping wheel, which releasably holds a leading edge of the sheet as it rotates, thereby flipping the sheet onto a stack support (or a sheet thereon). Such a sheet stacker is known from e.g. U.S. Pat. No. 9,457,980 B1. When the print media have a substantial length, or are formed of a weak and/or flexible material, the sheet may collapse upon itself during flipping. This may also occur with more rigid media, which can be locally weakened by the printing process due to interaction between the ink and the sheet material. It is known from e.g. U.S. Pat. No. 10,000,353 B2 to support the sheet with a gas flow during flipping to support the sheet during flipping.

SUMMARY OF THE INVENTION

It is an object of the invention to provide an alternative manner of preventing sheets from collapsing during flipping, preferably in an effective or efficient manner.

In accordance with the present invention, a method of stacking sheets according to claim 1 and a sheet stacker according to claim 8 are provided.

The method comprises the steps of:

- flipping a sheet while holding its leading edge and bringing said leading edge down towards a stack support;
- bringing a trailing portion of the sheet into contact with a guide member positioned over the stack support
- forming an overpressure in an inner volume of the bent sheet during flipping, while its trailing portion is in contact with the guide member; and
- maintaining said overpressure and contact while a trailing edge of the sheet travels along the guide member.

The sheet may be flipped via a rotational movement of its leading edge. The leading edge is thereby moved onto the stack support (or onto a sheet thereon). The guide member extends over the stack support and during the flipping process, a trailing portion of sheet following the leading edge is moved against the guide member. An overpressure is applied to the inside of the sheet, for example by means of a pressurized gas flow directed towards the inside of the sheet (the inside herein being the side facing the flipping device). The overpressure may also be applied to bring the trailing portion against the guide member. The overpressure is then maintained inside the bent sheet, forcing the trailing portion against the guide member during a substantial portion of the flipping process. The sheet remains in contact with the guide member, as its trailing edge moves along the guide member until it is released. In this manner, the overpressure is effectively maintained inside the bent sheet for a significant portion of the flipping process. The overpressure drives the bent sheet outward, effectively forcing the bent sheet to increase or at least maintain its radius of curvature. This prevents the sheet from collapsing, especially in case of sheets are made of weak media or comprise local weak points. Thereby the object of the present invention has been achieved.

More specific optional features of the invention are indicated in the dependent claims.

In an embodiment, the overpressure is formed by blowing gas into the inner volume. Pressurized gas may be jetted below the sheet to create the overpressure without deforming or damaging the sheet. Preferably, the gas is blown in an inclined direction, which is aimed upwards and in the direction wherein the trailing edge moves along the guide member. The gas flow is directed towards the guide member in the direction wherein the sheet rolls out during flipping. The inclined angle of the gas flow directs the trailing portion of the sheet against the guide member.

In an embodiment, the trailing portion contacts the guide member, such that gas is prevented from escaping from the inner volume along the trailing edge, at least until the trailing edge passes a release point on the guide member, which release point is determined by a length of the sheet. Gas is prevented from escaped along the trailing edge of the sheet to ensure that the overpressure is efficiently maintained. The guide member therefore preferably comprises a closed or sealed guide surface.

In an embodiment, an end of the guide member is positioned adjacent a flipping device and the overpressure presses the sheet against the guide member after the leading edge has passed the guide member. After the sheet has been engaged by the flipping device, the overpressure presses the sheet into contact with the guide member without affecting the hold of the flipping device on the sheet. By positioning the guide member close or adjacent the flipping device, the overpressure can be applied quickly after the sheet has been received by the flipping device.

In an embodiment, the overpressure is applied to sheets of a first media type, and wherein sheets of a second media type are flipped without overpressure, and wherein the grammage of the sheets of a second media type is greater than that of the sheets of the first media type. Sheets with a relatively high stiffness or rigidity are flipped without an overpressure, as their intrinsic rigidity prevents them from collapsing. Relatively weaker or flexible sheets require the overpressure to support them during flipping. The same may apply to sheets that have been submitted to a print process that locally weakens them. It will be appreciated that the sheet's dimensions also factor in its relative stiffness or rigidity. The application of the overpressure may be triggered upon the selection of the print media type for a print job and/or upon meeting certain print job conditions, such as a high local ink coverage. Certain print media types may have been designated for overpressure application and when one of such print media type is chosen, the overpressure is applied.

The present further relates to a sheet stacker for printed media, comprising:

- a flipping device for flipping a sheet onto a stack support or a stack of sheets on said stack support;
- a guide member positioned over the stack support and adjacent the flipping member to confine a flipping volume for the sheet;
- a gas nozzle positioned at the flipping device and inclined upwards towards the guide member, such that a trailing portion of the sheet is pressed against the guide member by means of a gas flow from the gas nozzle as the trailing portion travels along the guide member.

The guide member and the stack support define between them a confined flipping volume, which has a height substantially smaller than a length of the sheet. The sheet is flipped inside the flipping volume, while its trailing portion is forced against the guide member by the gas flow from the gas nozzle. The confined flipping volume ensures an effective build-up of the overpressure inside the sheet. Since the gas is effectively directed inside the bent sheet, it is relatively easy to maintain the overpressure inside the sheet. This results in an efficient support for the sheet during flipping, preventing it from collapsing.

In an embodiment, an upstream end of the guide member is positioned adjacent the flipping device. The guide member is close to the flipping device, such that the trailing portion can be swiftly brought into contact with the guide member after the sheet has been received by the flipping device. The guide member may partially extend over the flipping device.

In an embodiment, the guide member extends substantially parallel to the stack support. The guide member is positioned at a constant height from the stack support. The guide member may further extend in the horizontal direction over the majority of the stack support.

In an embodiment, the guide member comprises a closed surface with a width comparable to that of the sheet to be flipped and/or a length at least half a length of the sheet to be flipped. To contain the gas flow the guide member is sealed. The guide member provides a closed surface comparable in area to that the stack support, e.g. a similar width and/or at least half of the length of the stack support. The width is herein preferably defined in the direction of the axis around which the sheet is flipped, while the length is the horizontal direction in which the sheet rolls out during flipping.

In an embodiment, the gas nozzle is positioned with respect to the guide member, such that gas passes the sheet via its lateral edges and not via its trailing edge, while the sheet is pressed against the guide member. The gas flow is directed into an inner volume of the sheet, from which the gas can substantially escape only via the lateral edges of the sheet, while the trailing portion is in contact with the guide member. The sheet in contact with the guide member forms a barrier for the gas in the upwards and forward direction.

In an embodiment, the flipping device comprises a flipping wheel with at least one slot for receiving a leading edge of the sheet. The flipping wheel is rotatable while holding a sheet in its slot to rapidly flip said sheet, as described in U.S. Pat. No. 9,457,980 B1, the description of which flipping wheel in herein incorporated by reference.

In an embodiment, the guide member comprises a guide surface configured for sliding contact with the sheet. The guide surface is preferably a closed or sealed surface to prevent the gas flow from passing through. The guide surface further allows the sheet to slide unhindered along its surface, without damaging the sheet or the printed image on it. The guide surface is preferably smooth and/or has a low friction coefficient. The guide surface is further preferably at least as wide as a width of the sheet being flipped. The width herein being a dimension of the sheet in a lateral direction perpendicular to its flipping direction. In a preferred embodiment, the guide surface is formed by a non-permeable plate, for example a plate which is substantially 'airtight' so that air cannot pass through it.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE PREFERRED EMBODIMENTS

Figure 1:
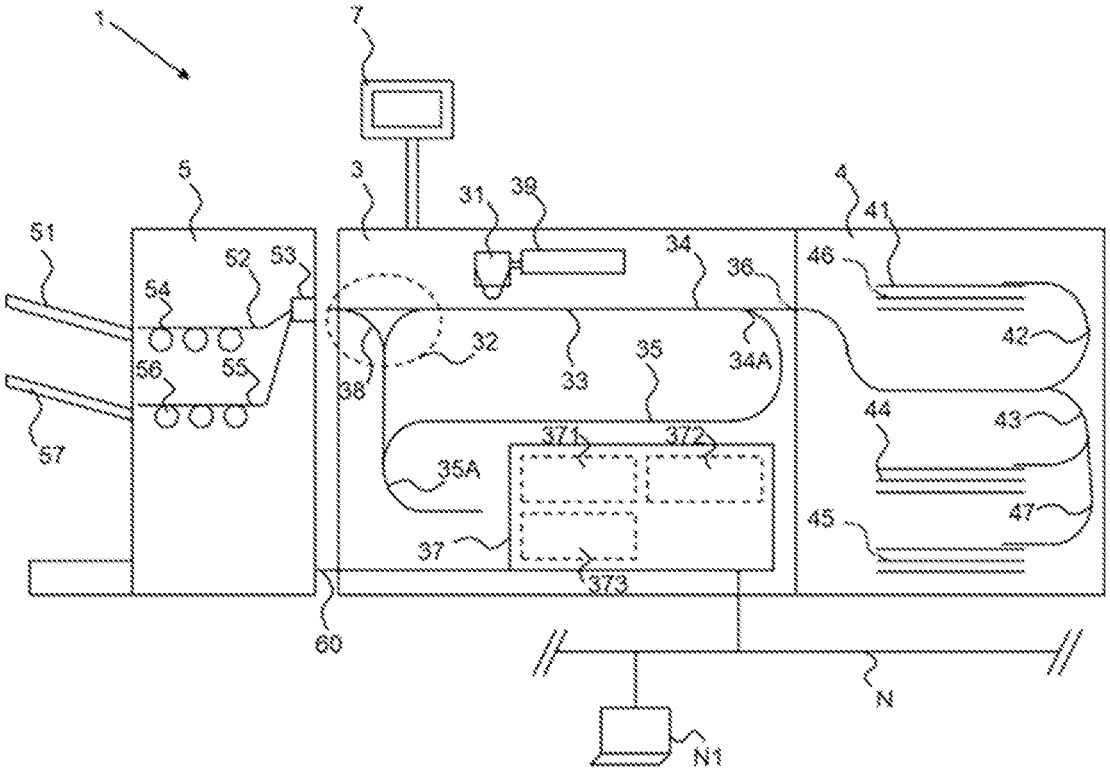
FIG. 1 is a schematic, cross-sectional side view of a sheet printing system.

The present invention will now be described with reference to the accompanying drawings, wherein the same reference numerals have been used to identify the same or similar elements throughout the several views.

Printing System

FIG. 1 shows schematically an embodiment of a printing system 1 according to the present invention. The printing system 1, for purposes of explanation, is divided into an output section 5, a print engine and control section 3, a local user interface 7 and an input section 4. While a specific printing system is shown and described, the disclosed embodiments may be used with other types of printing system such as an ink jet print system, an electrographic print system, etc.

The output section 5 comprises a first output holder 52 for holding printed image receiving material, for example a plurality of sheets. The output section 5 may comprise a second output holder 55. While 2 output holders are illustrated in FIG. 1, the number of output holders may include one, two, three or more output holders. The printed image receiving material is transported from the print engine and control section 3 via an inlet 53 to the output section 5. When a stack ejection command is invoked by the controller 37 for the first output holder 52, first guiding means 54 are activated in order to eject the plurality of sheets in the first output holder 52 outwards to a first external output holder 51. When a stack ejection command is invoked by the controller 37 for the second output holder 55, second guiding means 56 are activated in order to eject the plurality of sheets in the second output holder 55 outwards to a second external output holder 57.

The output section 5 is digitally connected by means of a cable 60 to the print engine and control section 3 for bi-directional data signal transfer.

The print engine and control section 3 comprises a print engine and a controller 37 for controlling the printing process and scheduling the plurality of sheets in a printing order before they are separated from input holder 44, 45, 46.

The controller 37 is a computer, a server or a workstation, connected to the print engine and connected to the digital environment of the printing system, for example a network N for transmitting a submitted print job to the printing system 1. In FIG. 1 the controller 37 is positioned inside the print engine and control section 3, but the controller 37 may also be at least partially positioned outside the print engine and control section 3 in connection with the network N in a workstation N1.

The controller 37 comprises a print job receiving section 371 permitting a user to submit a print job to the printing system 1, the print job comprising image data to be printed and a plurality of print job settings. The controller 37 comprises a print job queue section 372 comprising a print job queue for print jobs submitted to the printing system 1 and scheduled to be printed. The controller 37 comprises a sheet scheduling section 373 for determining for each of the plurality of sheets of the print jobs in the print job queue an entrance time in the paper path of the print engine and control section 3, especially an entrance time for the first pass and an entrance time for the second pass in the loop in the paper path according to the present invention. The sheet scheduling section 373 will also be called scheduler 373 hereinafter.

The sheet scheduling section 373 takes the length of the loop into account. The length of the loop corresponds to a loop time duration of a sheet going through the loop dependent on the velocity of the sheets in the loop. The loop time duration may vary per kind of sheet, i.e. a sheet with different media properties.

Resources may be recording material located in the input section 4, marking material located in a reservoir 39 near or in the print head or print assembly 31 of the print engine, or finishing material located near the print head or print assembly 31 of the print engine or located in the output section 5 (not shown).

The paper path comprises a plurality of paper path sections 32, 33, 34, 35 for transporting the image receiving material from an entry point 36 of the print engine and control section 3 along the print head or print assembly 31 to the inlet 53 of the output section 5. The paper path sections 32, 33, 34, 35 form a loop according to the present invention. The loop enables the printing of a duplex print job and/or a mix-plex job, i.e. a print job comprising a mix of sheets intended to be printed partially in a simplex mode and partially in a duplex mode.

The print head or print assembly 31 is suitable for ejecting and/or fixing marking material to image receiving material. The print head or print assembly 31 is positioned near the paper path section 34. The print head or print assembly 31 may be an inkjet print head, a direct imaging toner assembly or an indirect imaging toner assembly.

While an image receiving material is transported along the paper path section 34 in a first pass in the loop, the image receiving material receives the marking material through the print head or print assembly 31. A next paper path section 32 is a flip unit 32 for selecting a different subsequent paper path for simplex or duplex printing of the image receiving material. The flip unit 32 may be also used to flip a sheet of image receiving material after printing in simplex mode before the sheet leaves the print engine and control section 3 via a curved section 38 of the flip unit 32 and via the inlet 53 to the output section 5. The curved section 38 of the flip unit 32 may not be present and the turning of a simplex page has to be done via another paper path section 35.

In case of duplex printing on a sheet or when the curved section 38 is not present, the sheet is transported along the loop via paper path section 35A in order to turn the sheet for enabling printing on the other side of the sheet. The sheet is transported along the paper path section 35 until it reaches a merging point 34A at which sheets entering the paper path section 34 from the entry point 36 interweave with the sheets coming from the paper path section 35. The sheets entering the paper path section 34 from the entry point 36 are starting their first pass along the print head or print assembly 31 in the loop. The sheets coming from the paper path section 35 are starting their second pass along the print head or print assembly 31 in the loop. When a sheet has passed the print head or print assembly 31 for the second time in the second pass, the sheet is transported to the inlet 53 of the output section 5.

The input section 4 may comprise at least one input holder 44, 45, 46 for holding the image receiving material before transporting the sheets of image receiving material to the print engine and control section 3. Sheets of image receiving material are separated from the input holders 44, 45, 46 and guided from the input holders 44, 45, 46 by guiding means 42, 43, 47 to an outlet 36 for entrance in the print engine and control section 3. Each input holder 44, 45, 46 may be used for holding a different kind of image receiving material, i.e. sheets having different media properties. While 3 input holders are illustrated in FIG. 1, the number of input holders may include one, two, three or more input holders.

The local user interface 7 is suitable for displaying user interface windows for controlling the print job queue residing in the controller 37. In another embodiment a computer N1 in the network N has a user interface for displaying and controlling the print job queue of the printing system 1.

Stacker

Figure 2:
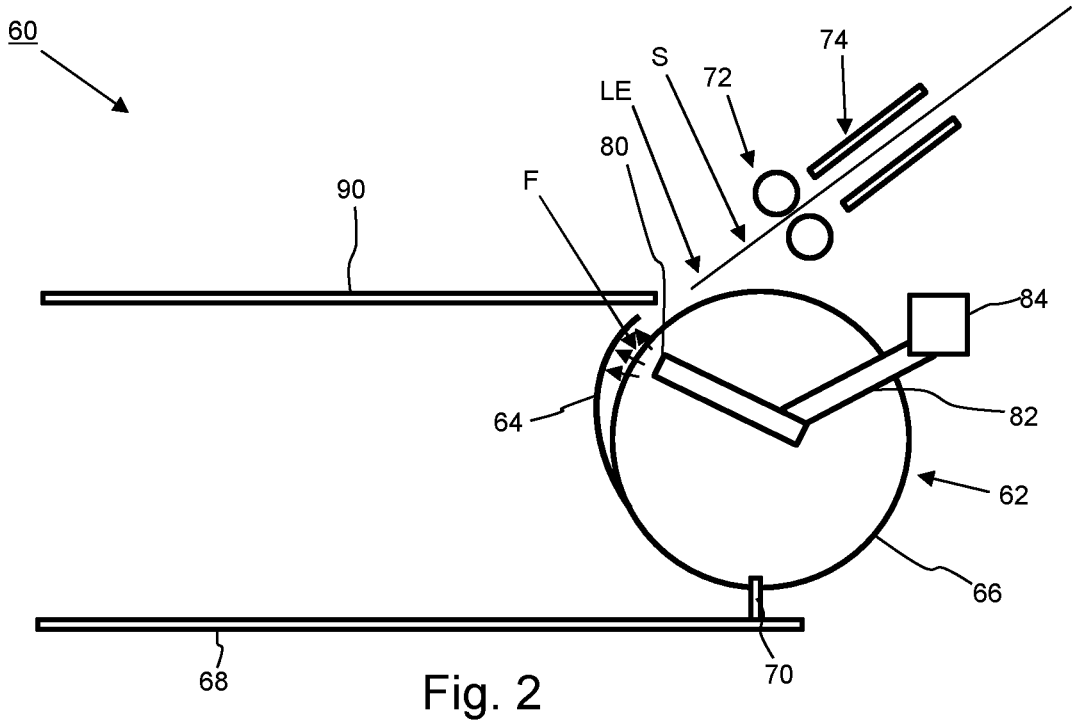
FIG. 2 is a schematic side view sheet stacker for use in the printing system of FIG. 1 in the step of inserting a sheet into the flipping device.

FIG. 2 illustrates a sheet stacker 60 which may be provided at the inlet 53 to form stacks of sheets at the desired output holder 52, 55. The sheet stacker 60 comprises a flipping device 62, which flips a received sheet S into an upside-down orientation as compared to the orientation in which the sheet S was received into the flipping device 62. The flipping device 62 comprises a flipping wheel 66 provided with one or more slots 64. The flipping wheel 66 is rotatable around its rotation axis by means of a motor (not shown). The slot 64 is configured to receive a leading edge LE of a sheet S from an inlet 53. The inlet 53 in FIG. 2 is formed of a sheet guide 74 for bringing sheets S to a transport pinch 72. The transport pinch 72 is preferably motorized such that it may inject the sheets S with the desired timing into the slot 64 of the flipping wheel 66. The flipping wheel 66 in FIG. 2 is oriented in its receiving position to allow the slot 64 to receive the sheet S from the inlet 53.

With the leading edge LE received in the slot 64, the flipping wheel 66 is rotated, thereby flipping the sheet S. The leading edge LE of the sheet S therein comes into contact with a stop element 70 positioned besides the flipping wheel 66 at the bottom side of the flipping wheel 66. By contacting the stop element 70, the leading edge LE is released from the slot 64. The trailing portion of the sheet S then rolls out onto the stack support 68 or a top sheet already on the stack support 68.

It was found that sheets S may collapse upon themselves during flipping. The radius of curvature of the bent sheet S can become relatively small in the case of thin, flexible, or weak print media. In such cases, the trailing portion collapses onto the portion which has already landed on the stack support 68. This may also happen with more rigid print media, which have been printed. The ink absorbed in the print media may result in weaker areas, where the sheet is then more prove to fold or bend. The present invention proposes a solution to prevent the radius of curvature of the bent sheet from becoming too small during flipping, thereby reducing the risk of collapsing the sheet S.

Thereto, a gas nozzle 80 is positioned at or near the flipping device 62. The gas nozzle 80 is in fluid connection to a blower 84 via line 82. The blower 84, when activated, transmits pressurized gas to the gas nozzle 80. The blower 84 may be configured as a fan or pump and the gas may be air or any other available gas. The gas nozzle 80 in FIG. 2 is positioned inclined with respect to the vertical direction. The gas nozzle 80 is aimed towards the guide member 90, which extends over the stack support 68. The guide member 90 is positioned vertically at a distance from the stack support 68, such that the flipping volume wherein the sheets S flips is delimited in the vertical direction. In FIG. 2, the guide member 90 extends as a plate or one or more beams parallel to the stack support 68. The guide member 90 is positioned at one end near the receiving position of the slot 64 and extends away from the flipping device 62 in the direction in which the sheet S rolls out during flipping. Said direction is preferably the horizontal direction. Preferably, the distance between the guide member 90 and the stack support 68 is around, comparable to, or similar to a diameter of the flipping wheel 66, for example within 150%, 140%, 130%, or 120% of said diameter.

Figure 3:
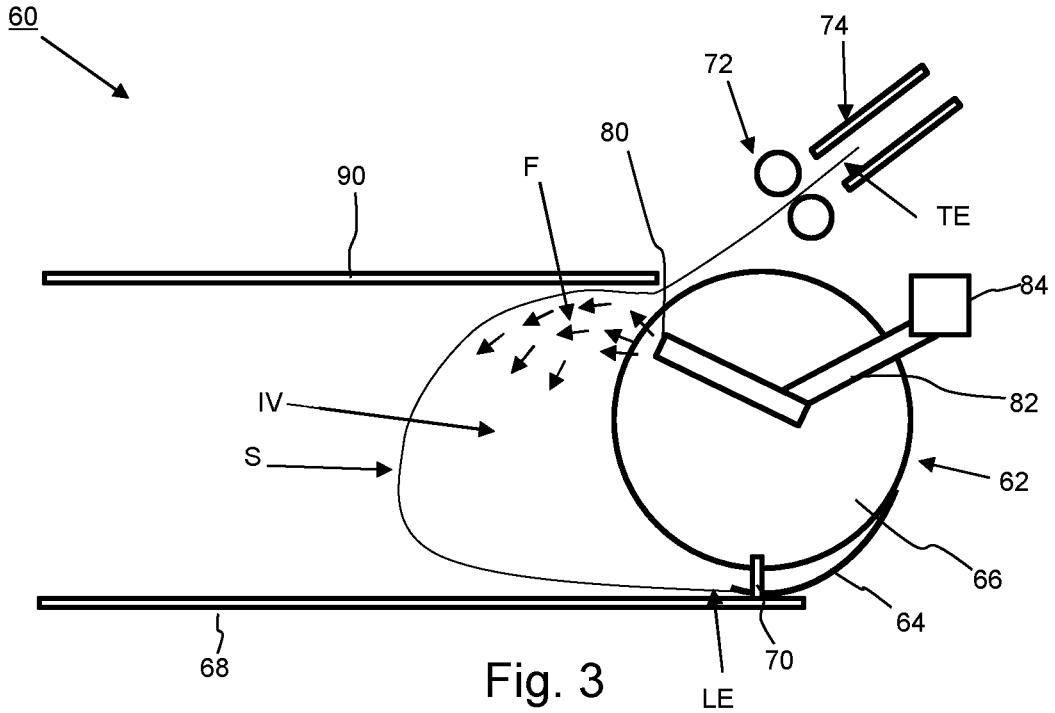
FIG. 3 is a schematic side view sheet stacker for use in the printing system of FIG. 2 in the step of the sheet contacting the guide member.

The gas nozzle 80 is configured to emit a gas flow F in the inclined direction towards the guide member 90. As shown in FIG. 3, after the leading edge LE has been inserted into the slot 64, the gas flow F is directed against an inner surface of the sheet S. In consequence a trailing portion of the sheet S below the guide member 90 is pressed against the guide member 90. The gas flow is directed in the horizontal direction away from the flipping device 62. Since the trailing portion of the sheet S is pressed against the guide member 90, the gas flow F cannot substantially pass by the sheet S in vertical direction. The gas flow F is forced to travel along the inner surface of the sheet S away from the flipping device and/or pass by the sheet S along the lateral edges of the sheet S. This partial sealing effect results in an effective build-up of overpressure inside this inner volume IV of the bent sheet S. This overpressure creates an outward force, which seeks to increase the radius of curvature of the bent sheet S. This prevents the sheet S from collapsing.

Figure 4:
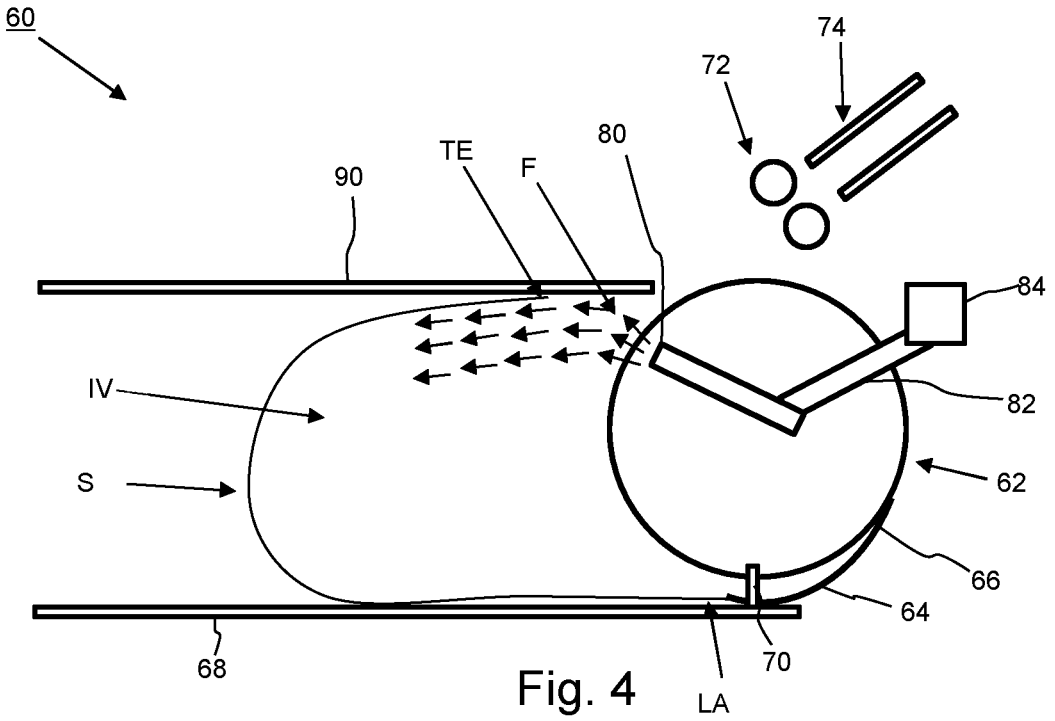
FIG. 4 is a schematic side view sheet stacker for use in the printing system of FIG. 2 in the step of the trailing edge moving along the guide member.
Figure 5:
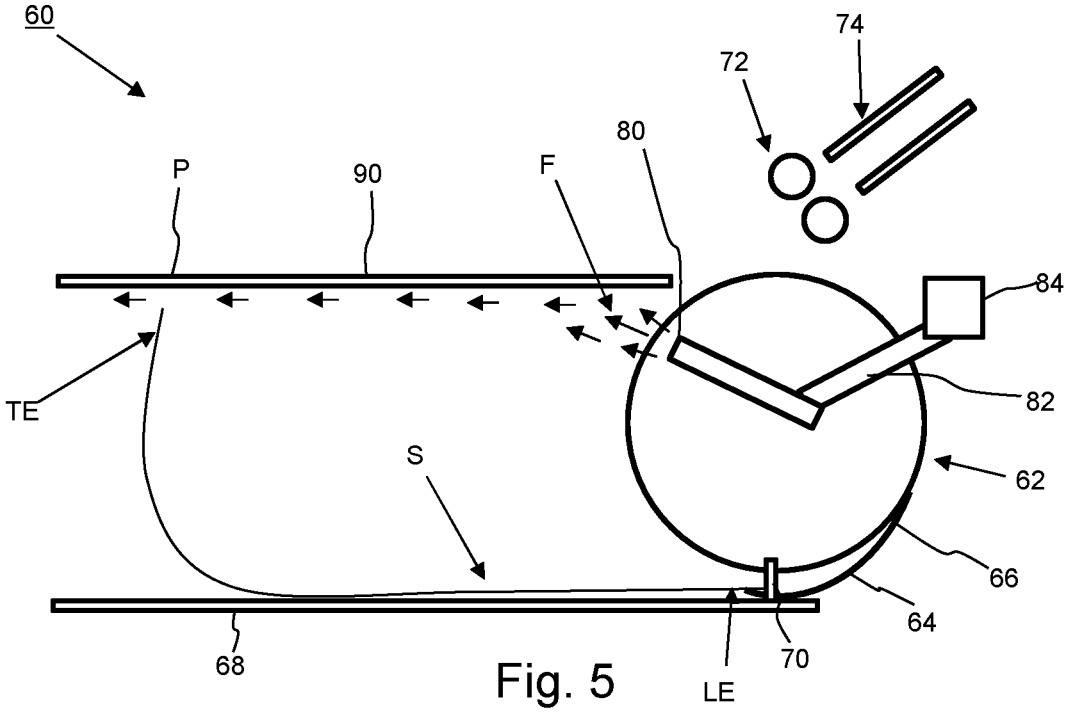
FIG. 5 is a schematic side view sheet stacker for use in the printing system of FIG. 2 in the step of releasing the sheet from the guide member.

FIG. 4 shows the trailing edge TE of the sheet S passes the gas nozzle 80 in the horizontal direction. The gas flow F is still being directed below the trailing portion of the sheet S via the guide member 90. In this manner the overpressure is maintained as the trailing edge TE slides further over the guide member 90. The trailing portion is kept in contact with the guide member 90 until its release as shown in FIG. 5. The guide member 90 comprises a closed or sealed surface, which directs the air flow F towards the trailing portion, even after the leading edge has passed the gas nozzle 80 (or the point on the guide member 90 towards which the gas nozzle 80 is aimed). The guide member 90 is formed as plate with a width comparable to that of the sheet S or the stack support 68. The guide member 90 is further formed of a smooth material, that allows the sheet S to slides over it without scratching the sheet S. The guide member 90 may for example be a metal or plastic plate.

FIG. 5 illustrates the trailing edge TE being released from the guide member 90. The trailing edge TE is released from the guide member 90 after it has traveled a certain distance along the guide member 90. This release point P is determined by the length of the sheet S, as well as its width, grammage, and/or air permeability. The position of the release point P may further be determined by controlling the gas flow or overpressure. After release, the remainder of the sheet S rolls out to lie flatly on the stack support 68 or on a sheet stack thereon.

Figure 6:
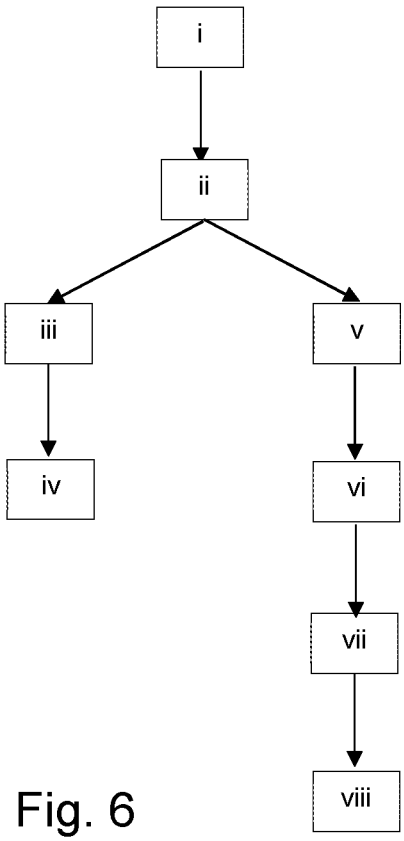
FIG. 6 is a block diagram illustrating the steps involved in a method for stacking sheets.

FIG. 6 illustrates the steps of the method according to the present invention. In step i, a print media type is selected, for example on the user interface 7 or via the network N1. The print media type may further be defined in the print job information. The selected media type correspond to the type of sheet intended to be printed in the respective print job. The selected media type in step ii is compared to a media catalog. In the media catalog an gas flow parameter is defined for a plurality or all print media types in the media catalog. Additionally, factors regarding the print job conditions, such as humidity, ink coverage, etc. may be taken into account when determining the gas flow parameter. The gas flow parameter defines a measure for the gas flow F from the gas nozzle 80 during stacking. The gas flow parameter may for example be proportional or based on a stiffness parameter. For stiffer media type, the gas flow parameter corresponds to zero gas flow. Such a stiffer media type has been selected in step iii. Consequently, the controller 37 controls the stacker 60 to perform the flipping of this stiffer media type without a supporting gas flow in step iv. These stiffer media types are in step iv flipped while the blower 84 is turned off.

In case a weaker media type is selected, as in step v, the controller 37 determines a suitable gas flow F. Values or parameters for the gas flow F may be stored in the media catalog for each media type or may be derived from a formula, model, graph, table, etc. stored on the controller's memory. In step vi, the blower 84 is turned on or a valve in line 82 is opened, to generate the gas flow F from the gas nozzle 80. The gas flow F may be timed to start just after the leading edge LE has entered the slot 64. The gas flow F is aimed upwards and away from the flipping device 62 towards the guide members 90. In step vii, the gas flow F presses a trailing portion of the sheet S against the guide member 90. This prevents the gas from passing by the sheet S along its trailing edge TE. Consequently, an overpressure is build up below the sheet S, which creates an outward force. This force prevents the sheet S from collapsing by forcing its radius of curvature to increase. This overpressure is maintained as the trailing portion of the sheet S travels along the guide member 90. In step viii, the sheet S is released from the guide member 90. Since the sheet S was supported by the air flow F for the majority of its flipping motion, the chance of the sheet S collapsing is reduced or prevented.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A method of stacking sheets, comprising the steps of:

flipping a sheet while holding a leading edge of the sheet and bringing said leading edge down towards a stack support;

bringing a trailing portion of the sheet into contact with a guide member positioned over the stack support;

blowing gas into an inner volume of the sheet to form an overpressure in the inner volume of the sheet during flipping, while the trailing portion is in contact with the guide member, wherein the gas is blown in an inclined direction, aimed upwards and in a direction a trailing edge of the sheet moves along the guide member;

maintaining said overpressure and contact while the trailing edge of the sheet travels along a contact surface of the guide member, wherein the contact surface is stationary while in contact with the trailing edge, and wherein the trailing portion contacts the guide member, such that gas is prevented from escaping from the inner volume along the trailing edge, at least until the trailing edge passes a release point on the guide member, the release point being determined by a length of sheet.

2. The method according to claim 1, wherein the guide surface is substantially closed or sealed and has a width substantially equal to and/or at least as wide as a width of the sheet being flipped.

3. The method according to claim 1, wherein an end of the guide member is positioned adjacent a flipping device and the overpressure presses the sheet against the guide member after the leading edge has passed the guide member.

4. The method according to claim 1, wherein the overpressure is applied to sheets of a first media type, and wherein sheets of a second media type are flipped without overpressure, and wherein a grammage of the sheets of a second media type is greater than a grammage of the sheets of the first media type.

5. The method according to claim 1, wherein the overpressure is applied by means of a gas nozzle positioned at a flipping device and aimed upwards and away from the flipping device in a direction in which the sheet rolls out during flipping.

6. A sheet stacker for printed media, comprising:

a flipping device for flipping a sheet onto a stack support or a stack of sheets on said stack support, wherein the flipping device comprises a flipping wheel with at least one slot for receiving a leading edge of the sheet;

a guide member positioned over the stack support and adjacent the flipping device to confine a flipping volume for the sheet; and a gas nozzle positioned at the flipping device and inclined upwards towards the guide member, the gas nozzle being configured to blow gas such that a trailing portion of the sheet is pressed against the guide member by a gas flow from the gas nozzle as the trailing portion travels along a guide surface of the guide member, wherein the guide surface is configured to be stationary while in contact with the trailing portion.

7. The sheet stacker according to claim 6, wherein an upstream end of the guide member is positioned adjacent the flipping device.

8. The sheet stacker according to claim 6, wherein the guide member extends substantially parallel to the stack support.

9. The sheet stacker according to claim 6, wherein the guide member comprises a closed or sealed guide surface, which prevents passage of the gas flow through the guide member.

10. The sheet stacker according to claim 9, wherein the guide surface is configured for sliding contact with the sheet.

11. The sheet stacker according to claim 9, wherein the gas nozzle is positioned with respect to the guide member, such that gas passes the sheet via lateral edges thereof and not via a trailing edge thereof, while the sheet is pressed against the guide member.

12. A sheet printing system comprising the sheet stacker according to claim 6.

13. A method of stacking sheets, comprising the steps of:

flipping a sheet while holding a leading edge of the sheet and bringing said leading edge down towards a stack support;

bringing a trailing portion of the sheet into contact with a guide member positioned over the stack support;

blowing gas into an inner volume of the sheet to form an overpressure in the inner volume of the sheet during flipping, while the trailing portion is in contact with the guide member, wherein the gas is blown in an inclined direction, aimed upwards and in a direction a trailing edge of the sheet moves along the guide member; and maintaining said overpressure and contact while the trailing edge of the sheet travels along the guide member, wherein the trailing portion contacts the guide member, such that gas is prevented from escaping from the inner volume along the trailing edge, at least until the trailing edge passes a release point on the guide member, the release point being determined by a length of sheet.

14. The method according to claim 13, wherein an end of the guide member is positioned adjacent a flipping device and the overpressure presses the sheet against the guide member after the leading edge has passed the guide member.

15. The method according to claim 13, wherein the overpressure is applied to sheets of a first media type, and wherein sheets of a second media type are flipped without overpressure, and wherein a grammage of the sheets of a second media type is greater than a grammage of the sheets of the first media type.

16. The method according to claim 13, wherein the overpressure is applied by a gas nozzle positioned at a flipping device and aimed upwards and away from the flipping device in a direction in which the sheet rolls out during flipping.

* * * * *